US011572757B2

(12) United States Patent
Krueger et al.

(10) Patent No.: US 11,572,757 B2
(45) Date of Patent: Feb. 7, 2023

(54) BACKUP RING WITH CONTROL LINE PROTECTION, SYSTEMS, AND METHODS

(71) Applicants: Matt Krueger, Cypress, TX (US); Frank Maenza, Houston, TX (US); Dennis Jiral, Katy, TX (US); Chee Kong Yee, Katy, TX (US); Daniel Sequera, Houston, TX (US)

(72) Inventors: Matt Krueger, Cypress, TX (US); Frank Maenza, Houston, TX (US); Dennis Jiral, Katy, TX (US); Chee Kong Yee, Katy, TX (US); Daniel Sequera, Houston, TX (US)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 5 days.

(21) Appl. No.: 17/081,053

(22) Filed: Oct. 27, 2020

(65) Prior Publication Data

US 2022/0127914 A1 Apr. 28, 2022

(51) Int. Cl.

| | |
|---|---|
| ***E21B 33/12*** | (2006.01) |
| ***E21B 17/10*** | (2006.01) |
| ***E21B 23/14*** | (2006.01) |

(52) U.S. Cl.

CPC ..... *E21B 33/1208* (2013.01); *E21B 17/1085* (2013.01); *E21B 23/14* (2013.01); *E21B 2200/01* (2020.05)

(58) Field of Classification Search

CPC ... E21B 33/1208; E21B 33/1216; E21B 47/12

See application file for complete search history.

(56) References Cited

U.S. PATENT DOCUMENTS

| | | | | |
|---|---|---|---|---|
| 6,173,788 | B1 | 1/2001 | Lembcke et al. | |
| 2009/0283254 | A1 | 11/2009 | Andersen et al. | |
| 2014/0014373 | A1 | 1/2014 | Richards | |
| 2014/0224476 | A1* | 8/2014 | Frazier | E21B 33/1216 166/135 |
| 2015/0226023 | A1 | 8/2015 | Scruggs et al. | |
| 2018/0148997 | A1* | 5/2018 | Goodman | E21B 33/1208 |

OTHER PUBLICATIONS

Notification of the International Search Report and the Written Opinion; PCT/US2021/056549; dated Feb. 8, 2022; 7 pages.

* cited by examiner

*Primary Examiner* — Kristyn A Hall
(74) *Attorney, Agent, or Firm* — Cantor Colburn LLP

(57) ABSTRACT

A backup ring for a seal assembly including a body having a radially outer surface and a radially inner surface, an opening in the body extending from the radially outer surface toward the radially inner surface, the opening being receptive to a line to guide and protect the line. A wellbore system including a borehole in a subsurface formation, a string disposed in the borehole, a seal system disposed in the string, the system including a backup ring comprising a body having a radially outer surface and a radially inner surface and an opening in the body extending from the radially outer surface toward the radially inner surface, the opening being receptive to a line to guide and protect the line and a method for running a line along a seal system.

20 Claims, 10 Drawing Sheets

BACKUP RING WITH CONTROL LINE PROTECTION, SYSTEMS, AND METHODS

BACKGROUND

In the resource recovery industry seal systems are ubiquitously used to temporarily or permanently hold a pressure differential in a borehole. Systems may sometimes also need to pass control lines, electric lines, etc. These may be passed below an element of the seal system and then spliced while running in the hole but time is lost and cost is substantial due to actions required for splicing and for testing of the splices to ensure functionality and regulatory compliance. Innovations that permit the passage of lines beyond seal systems without the need for splicing operations would be well received by the art.

SUMMARY

An embodiment of a backup ring for a seal assembly including a body having a radially outer surface and a radially inner surface, an opening in the body extending from the radially outer surface toward the radially inner surface, the opening being receptive to a line to guide and protect the line.

An embodiment of a wellbore system including a borehole in a subsurface formation, a string disposed in the borehole, a seal system disposed in the string, the system including a backup ring comprising a body having a radially outer surface and a radially inner surface and an opening in the body extending from the radially outer surface toward the radially inner surface, the opening being receptive to a line to guide and protect the line.

A method for running a line along a seal system including disposing a line in an opening of a backup ring making up a part of a seal system, setting the seal system, and guiding and protecting the line in the opening during the setting.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
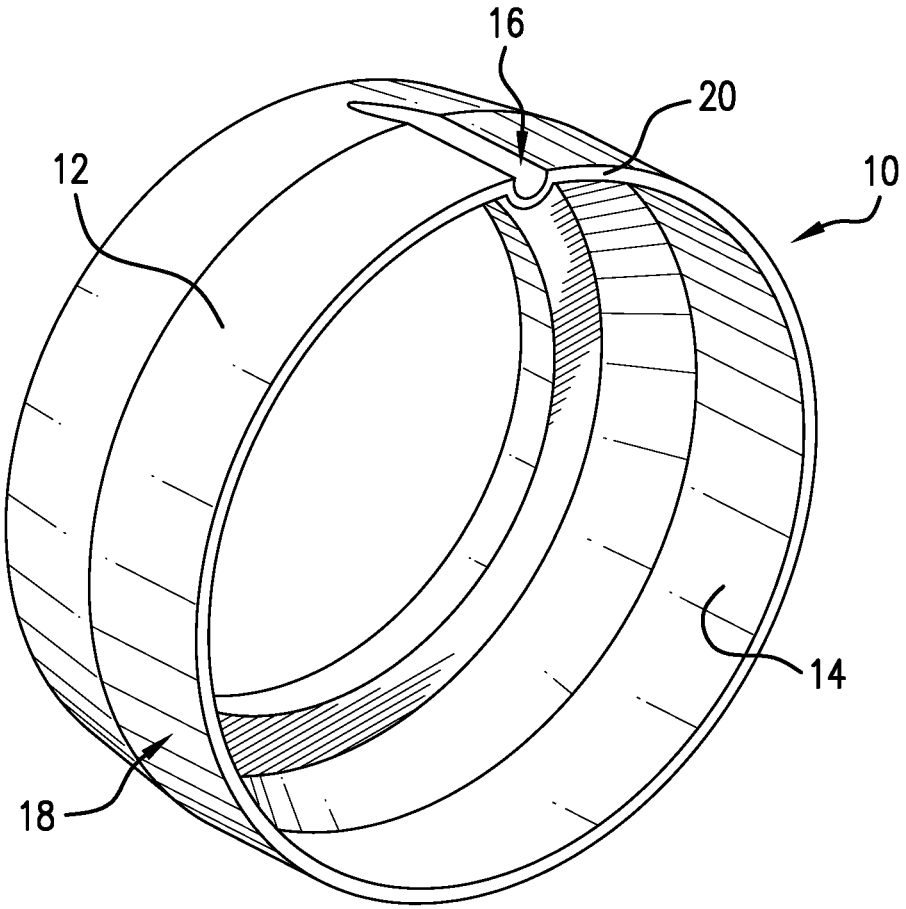
FIG. 1 is a perspective view of a first embodiment of a backup ring with a line opening as disclosed herein.

Referring to FIG. 1, a first embodiment of a backup ring 10. The backup ring 10 defines a radially outer surface 12 and a radially inner surface 14. Further an opening 16 extends radially inwardly from the outer surface 12 toward the inner surface 14. In embodiments, the opening does not reach the inner surface 14 as is shown in FIG. 1 though it is also contemplated that the opening 16 could reach the inner surface 14 if desired for a particular need. The opening 16 may be characterized as a groove in some variations. The opening 16 is sized such that a line (not shown) that may be a control line, electric line, etc. (and herein referred to generically as "line") may be disposed therein. The opening 16 in variations may be dimensioned to accept from 1% of the line (in cross sectional area) to 100% of the line (again in cross sectional area) and in embodiments from 20% to 50% of the line (in cross sectional area). In some embodiments, the opening is dimensioned to receive the line and have a clearance for the line of 0 to 1 times a diameter of the line. In addition, it is contemplated that a resilient material may be disposed in the opening 16. That material may be a rubber, soft metal, plastic, etc. The form of that material could be configured as a lining of the opening 16 and thereby mimic the shape thereof or could substantially fill the opening 16 (in which case the material selected would be quite soft such that the line would displace that material to ensure the line is received in the opening 16), or could be anywhere in between. The material serves the purpose of sealing the line to the backup ring 10 and reduces extrusion gaps between the line and backup ring 10. The material may also serve an additional purpose of sealing the line to a casing in which the backup ring is to be set.

Figure 2:
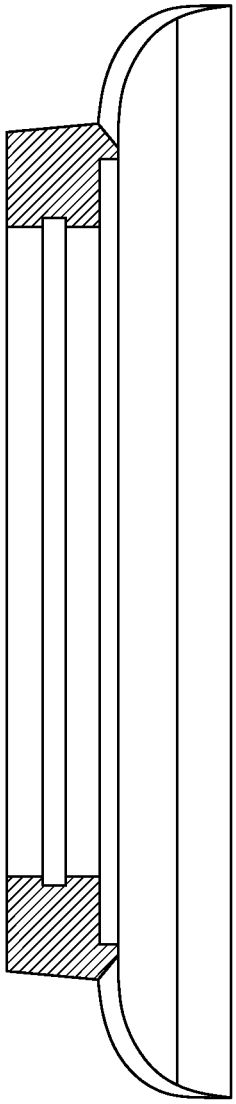
FIG. 2 is a view illustrating the backup ring in a deployed position.
Figure 3:
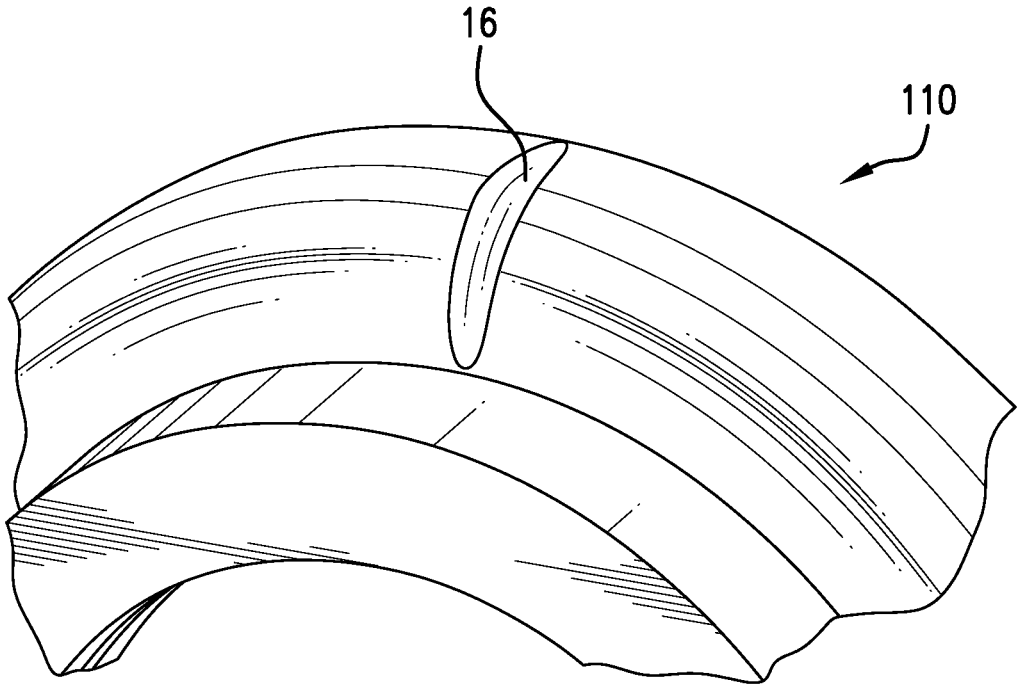
FIG. 3 is another view illustrating the backup ring in a deployed position.

It will be appreciated that in FIG. 1 the backup ring 10 is illustrated alone and in a condition that is prior to setting. The line will simply lie in opening 16. Upon setting of the seal system of which the backup ring 10 is a part, end 18 of ring 10 will flare outwardly toward a tubular member. The flare is visible in FIGS. 2 and 3. The opening 16 is still visible at a radial edge of the backup 10 in the flared deployed position. Accordingly, the line may still pass the backup in relative protected state.

Figure 4:
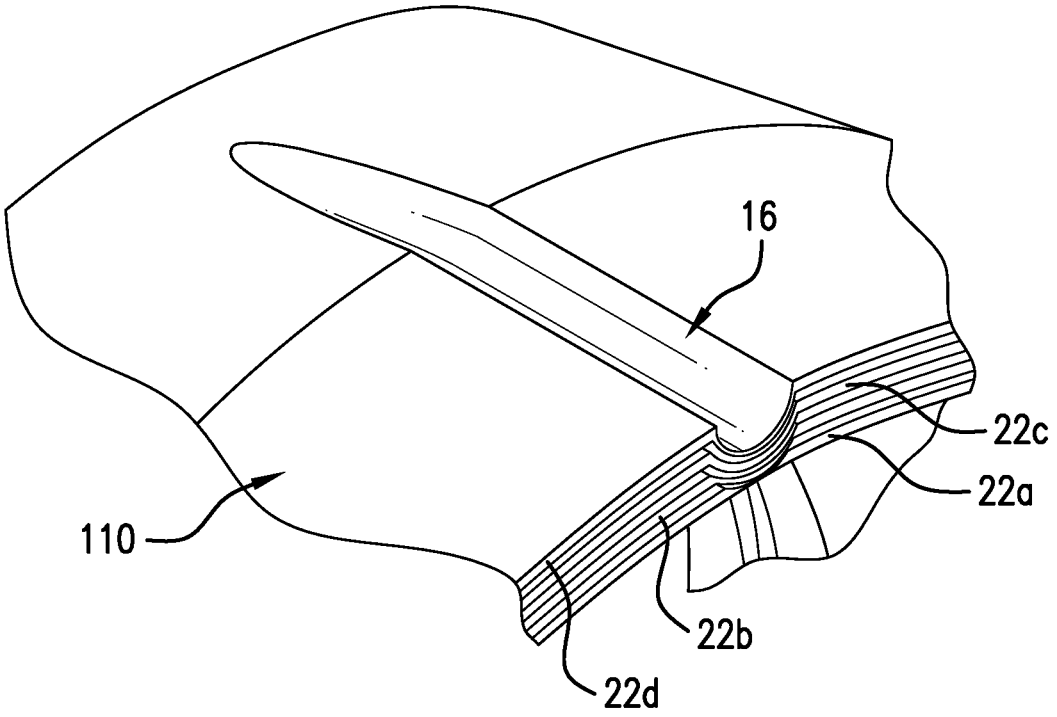
FIG. 4 is a perspective view of a second embodiment of a backup ring with a line opening as disclosed herein.
Figure 5:
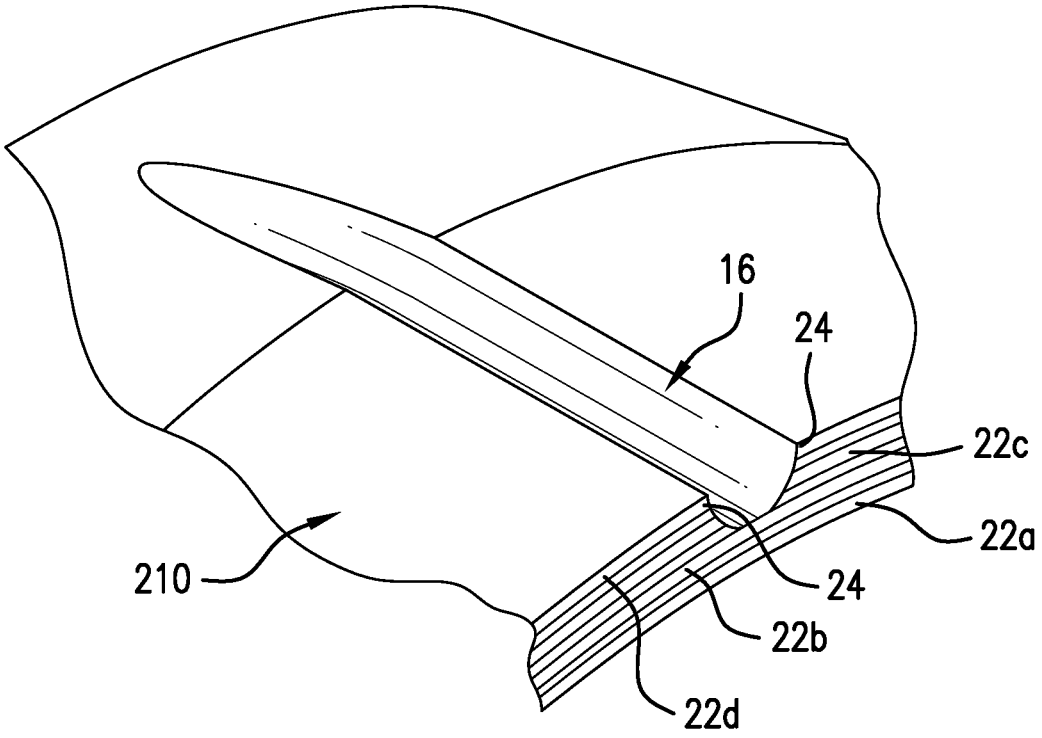
FIG. 5 is a perspective view of a third embodiment of a backup ring with a line opening as disclosed herein.

Referring to FIGS. 4 and 5, an alternate embodiments are illustrated that include a number of petals 22*a-d* in a backup ring 110 or 210 instead of the single piece construction (shown at 20 in FIG. 1) of backup ring 10. Petals are relatively common for backup rings but not with an opening 16. Two embodiments where petals are employed and include an opening 16 are illustrated in FIGS. 4 and 5. In the FIG. 4 embodiment, each petal 22*a-d* follows a path that deviates radially inwardly to create the opening 16. The petals may be deformed to this position or formed in this position. In FIG. 5, it will be appreciated that the opening 16 is created by aligning edges 24 of petals 22*c* and 22*d* and leaving a gap therebetween to form opening 16. Functionally the embodiments of FIGS. 4 and 5 operate as do the embodiment of FIGS. 1-3.

Figure 6:
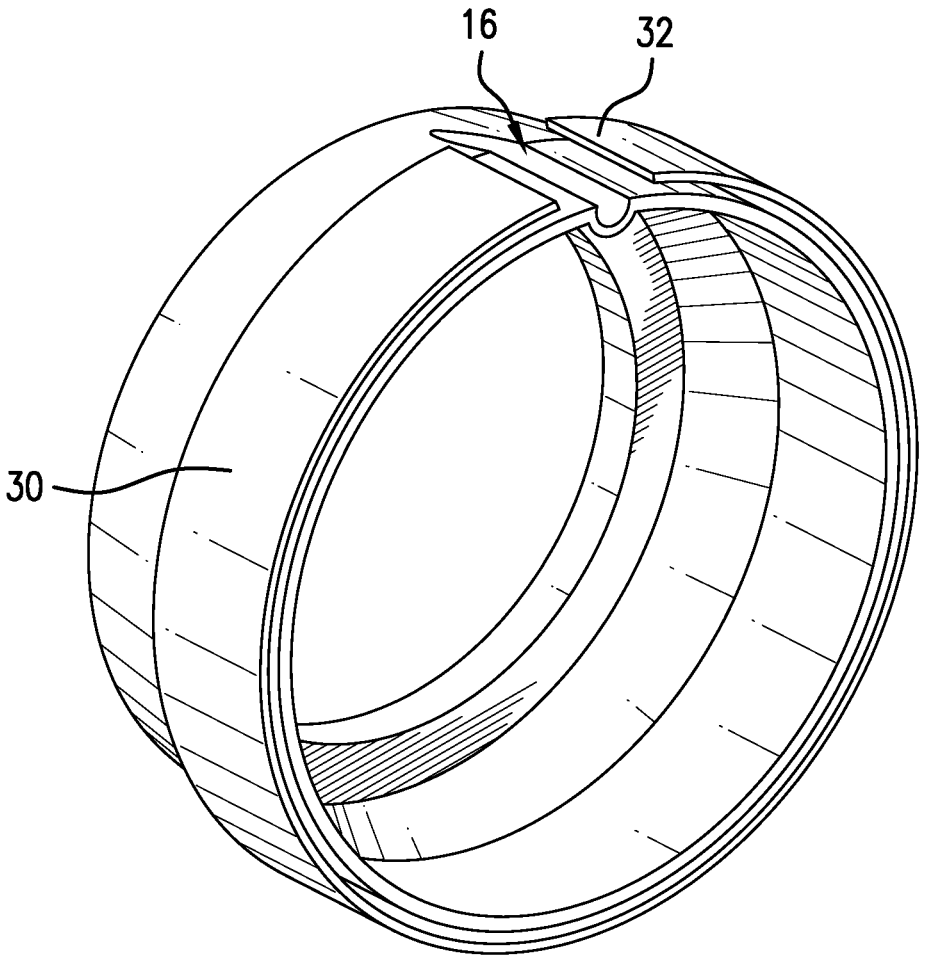
FIG. 6 is a perspective view of a first cover embodiment in a first position for the backup rings of FIGS. 1-3 as disclosed herein.
Figure 7:
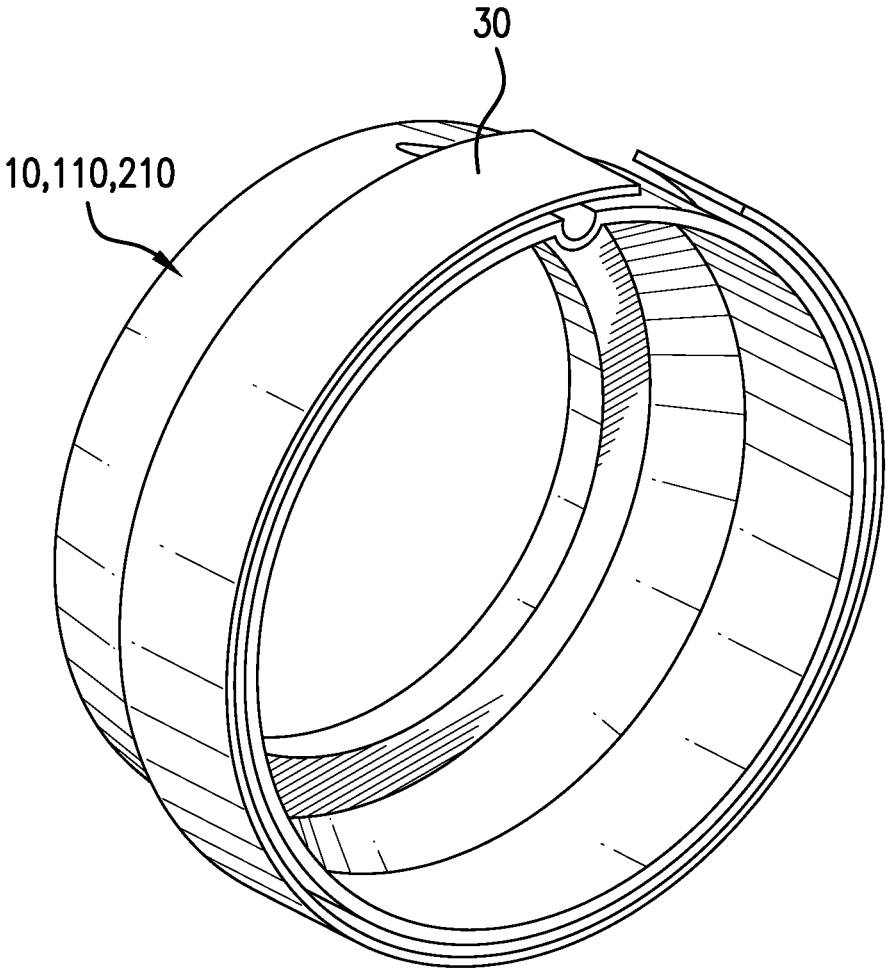
FIG. 7 is a perspective view of the first cover embodiment in a second position for the backup rings of FIGS. 1-3 as disclosed herein.

Referring to FIGS. 6 and 7, another embodiment adds a cover 30 to the backup ring 10, 110, 210. The cover 30 includes a gap 32 that can be aligned and misaligned with the opening 16. The cover 30 would in practice be rotated to align the gap 32 with the opening 16 to insert a line (FIG. 6) therein and then rotated to cover the line in the opening 16 (FIG. 7). The cover 30 is inexpensive to construct and simple but only offers protection for a small number of lines since it has no annularly complete structure. Rather it is essentially a C ring and hence must have a gap that is smaller than 50% of the circumference of the ring. The cover 30 is constructed of rubber, soft metal, plastic, etc.

Figure 8:
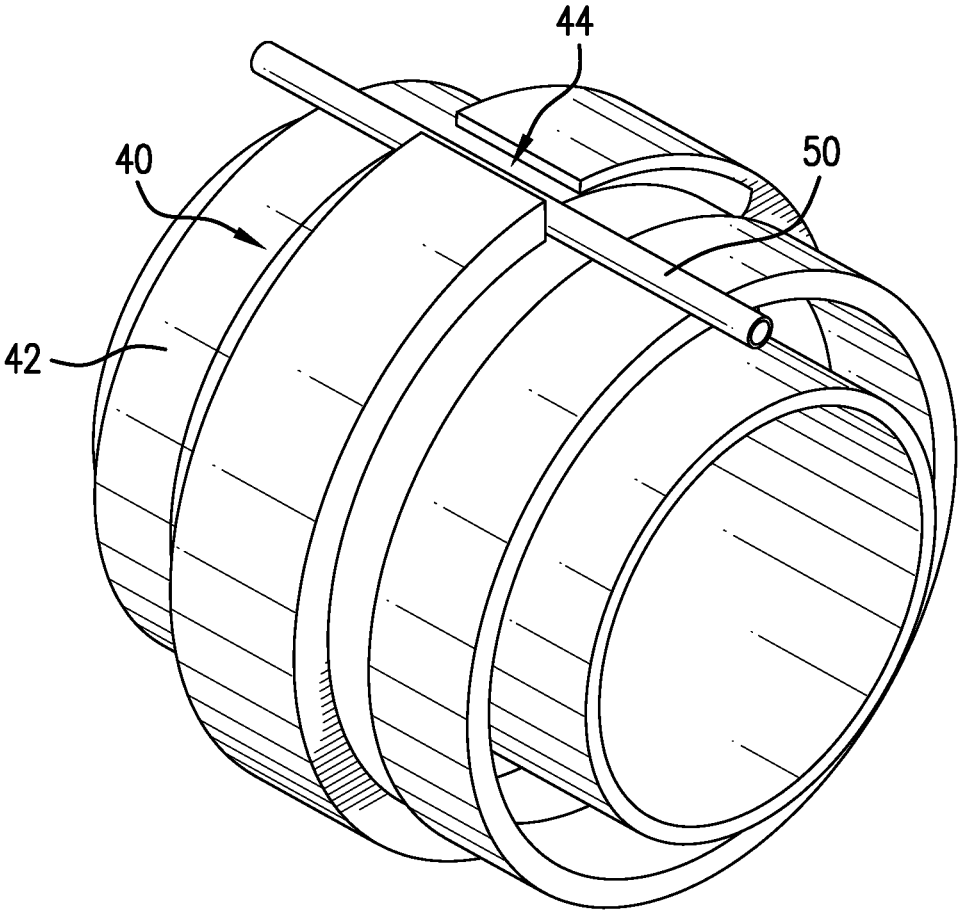
FIG. 8 is a perspective view of a second cover embodiment in a first position for the backup rings of FIGS. 1-3 as disclosed herein.
Figure 9:
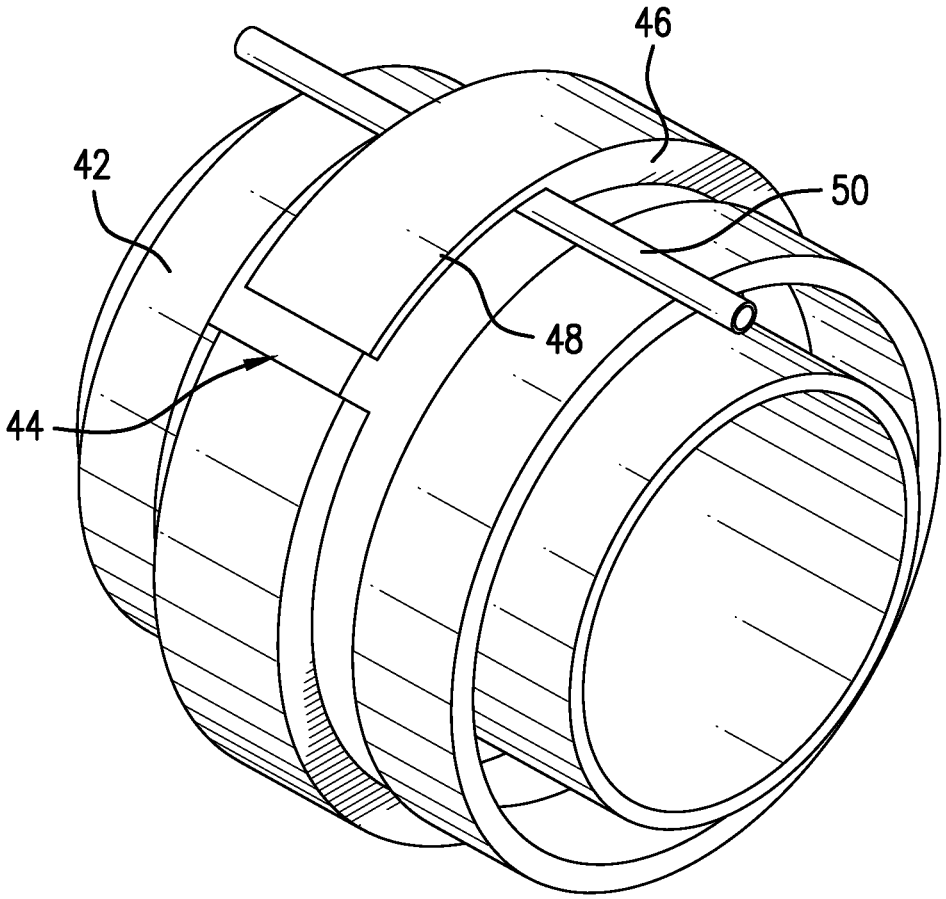
FIG. 9 is a perspective view of the second cover embodiment in a second position for the backup rings of FIGS. 1-3 as disclosed herein.

Referring to FIGS. 8 and 9, another cover 40) is illustrated in conjunction with the backup rings 10, 110, 210 and provides the added advantage of an annularly closed base 42 such that a number of gaps 44 may be created to align and misalign with a number of openings 16. Also, this cover embodiment is configured to have a radial thickness identified at numeral 46 that is reduced at overhang 48 that protects a line 50 radially thereunder.

Figure 10:
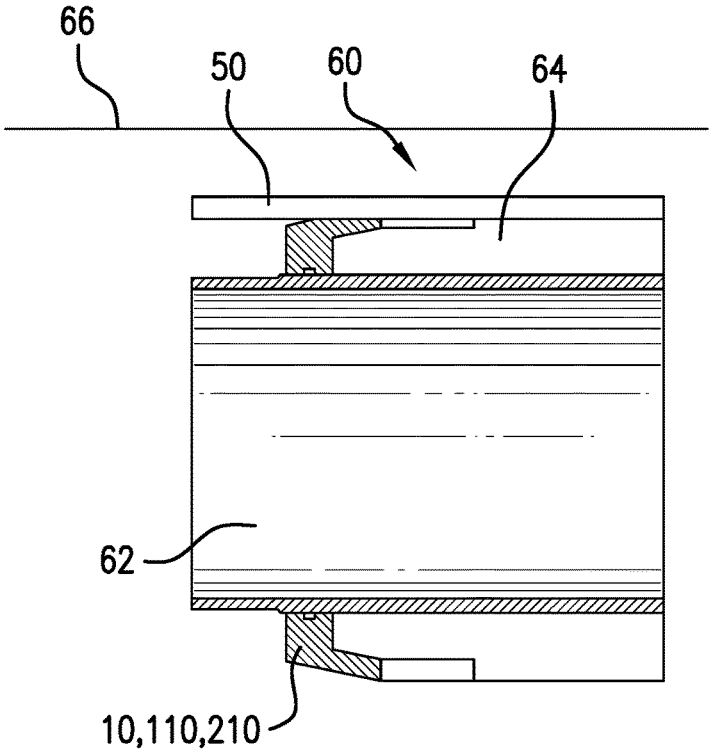
FIG. 10 is a schematic cross-sectional view of a seal system as disclosed herein in a run in position.
Figure 11:
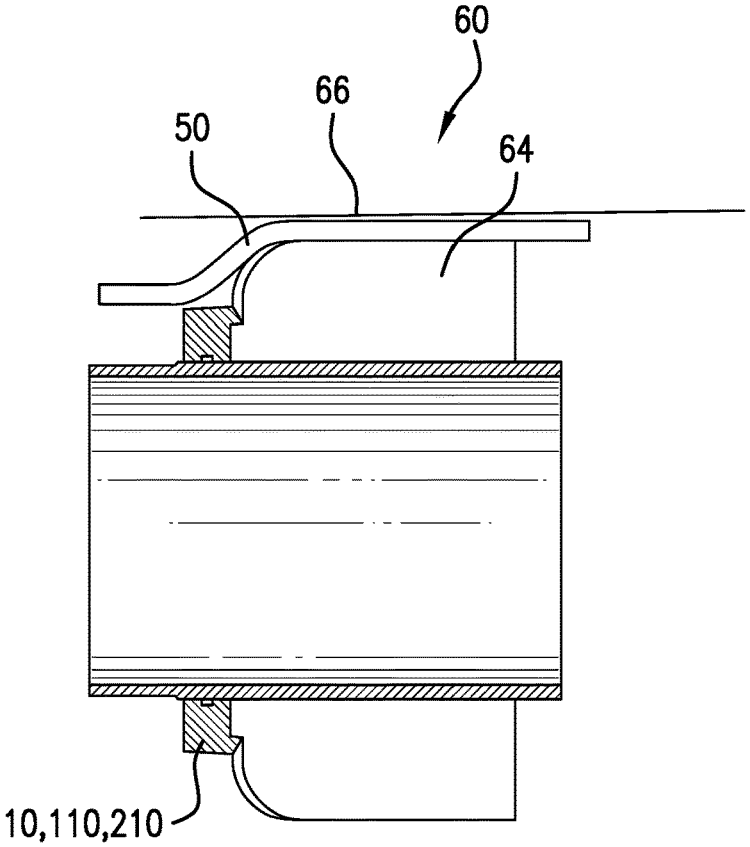
FIG. 11 is a schematic cross-sectional view of the seal system of FIG. 10 in a set position.

Referring to FIGS. 10 and 11, a seal system 60 that employs the backup ring 10, 110, 210 disclosed above is illustrated in a run in (FIG. 10) and a set (FIG. 11) position. The system 60 includes at least a mandrel 62, an element 64 disposed about the mandrel, a backup as disclosed herein 110, 110, 210 adjacent the element 64 and a line 50 disposed in the opening 16 of the backup 10, 110, 210. It will be appreciated that as the element 64 expands outwardly to set against a structure 66 (tubular or open hole), the line 50 will be guided by opening 16 and protected thereby. In other respects, the seal system operates as do traditional systems having the features described but without the opening 16.

Figure 12:
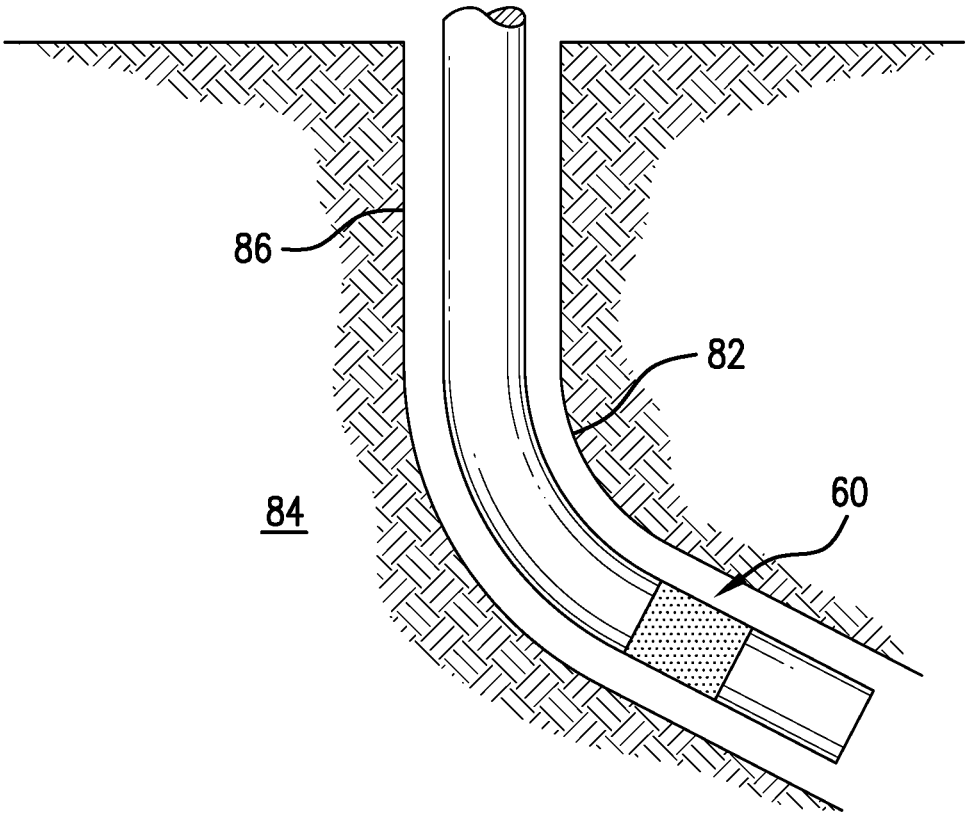
FIG. 12 is a schematic representation of a wellbore system as disclosed herein.

Referring to FIG. 12, a wellbore system 80 is schematically illustrated comprising a borehole 82 in a formation 84. A string 86 is disposed in the borehole 82 and a seal system 60 is disposed in the string. While this drawing indicates a string 86, it is to be appreciated that the seal system 60 may be set in a string or be run on a string to be set in the open hole. Accordingly, the seal system 60 illustrated in FIG. 12 may set against string 86 or against borehole 82.

Set forth below are some embodiments of the foregoing disclosure:

Embodiment 1: A backup ring for a seal assembly including a body having a radially outer surface and a radially inner surface, an opening in the body extending from the radially outer surface toward the radially inner surface, the opening being receptive to a line to guide and protect the line.

Embodiment 2: The backup ring as in any prior embodiment, wherein the opening contains a resilient material.

Embodiment 3: The backup ring as in any prior embodiment, wherein the opening is a groove.

Embodiment 4: The backup ring as in any prior embodiment, wherein the body is solid.

Embodiment 5: The backup ring as in any prior embodiment, wherein the body comprises a plurality of petals.

Embodiment 6: The backup ring as in any prior embodiment, wherein the petals are arranged to define the opening at ends of the petals.

Embodiment 7: The backup ring as in any prior embodiment, wherein the opening is defined by a deformation of the petals radially at the opening.

Embodiment 8: The backup ring as in any prior embodiment, wherein the groove is dimensioned to receive the line and have a clearance for the line of 0 to 1 times a diameter of the line.

Embodiment 9: The backup ring as in any prior embodiment, wherein the opening is sufficiently deep in the body to accommodate up to 100% of a cross sectional area of the line.

Embodiment 10: The backup ring as in any prior embodiment, wherein the resilient material seals the line to the body.

Embodiment 11: The backup ring as in any prior embodiment, wherein the resilient material seals the line to a structure in which the seal assembly is to be set, during use.

Embodiment 12: The backup ring as in any prior embodiment, further comprising a covering disposed radially outwardly of the body and the line.

Embodiment 13: The backup ring as in any prior embodiment, wherein the covering is resilient.

Embodiment 14: The backup ring as in any prior embodiment, wherein the covering is rotatable to retain the line in the opening.

Embodiment 15: The backup ring as in any prior embodiment, wherein the covering includes a support base that is annularly complete and a protection portion that includes a gap for passage of line radially through the covering.

Embodiment 16: A seal system including a mandrel, an element disposed about the mandrel, and a backup ring as in any prior embodiment disposed about the mandrel adjacent the element.

Embodiment 17: A wellbore system including a borehole in a subsurface formation, a string disposed in the borehole, a seal system disposed in the string, the system including a backup ring comprising a body having a radially outer surface and a radially inner surface and an opening in the body extending from the radially outer surface toward the radially inner surface, the opening being receptive to a line to guide and protect the line.

Embodiment 18: The wellbore system as in any prior embodiment, further comprising a line extending along the string, the line extending across the seal system along the outside surface of the backup ring by passing along the opening.

Embodiment 19: A method for running a line along a seal system including disposing a line in an opening of a backup ring making up a part of a seal system, setting the seal system, and guiding and protecting the line in the opening during the setting.

Embodiment 20: The method as in any prior embodiment, further comprising disposing a cover over the line in the opening.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The modifier "about" used in connection with a quantity is inclusive of the stated value and has the meaning dictated by the context (e.g., it includes the degree of error associated with measurement of the particular quantity).

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. An expandable backup ring for a seal assembly comprising:

An expandable body having a radially outer surface and a radially inner surface;

an opening in the body extending from the radially outer surface toward the radially inner surface, without reaching the radially inner surface, the opening being receptive to a line to guide and protect the line.

2. The backup ring as claimed in claim 1 wherein the opening contains a resilient material.

3. The backup ring as claimed in claim 2 wherein the resilient material seals the line to the body.

4. The backup ring as claimed in claim 3 wherein the resilient material seals the line to a structure in which the seal assembly is to be set, during use.

5. The backup ring as claimed in claim 1 wherein the opening is a groove.

6. The backup ring as claimed in claim 1 wherein the body is solid.

7. The backup ring as claimed in claim 1 wherein the body comprises a plurality of petals.

8. The backup ring as claimed in claim 7 wherein the petals are arranged to define the opening at ends of the petals.

9. The backup ring as claimed in claim 7 wherein the opening is defined by a deformation of the petals radially at the opening.

10. The backup ring as claimed in claim 1 wherein the groove is dimensioned to receive the line and have a clearance for the line of 0 to 1 times a diameter of the line.

11. The backup ring as claimed in claim 1 wherein the opening is sufficiently deep in the body to accommodate up to 100% of a cross sectional area of the line.

12. The backup ring as claimed in claim 1, further comprising a covering disposed radially outwardly of the body and the line.

13. The backup ring as claimed in claim 12 wherein the covering is resilient.

14. The backup ring as claimed in claim 12 wherein the covering is rotatable to retain the line in the opening.

15. The backup ring as claimed in claim 12 wherein the covering includes a support base that is annularly complete and a protection portion that includes a gap for passage of line radially through the covering.

16. A seal system comprising:

a mandrel;

an element disposed about the mandrel; and a backup ring as claimed in claim 1 disposed about the mandrel adjacent the element.

17. A method for running a line along a seal system comprising:

disposing a line in an opening of the backup ring as claimed in claim 1 making up a part of a seal system;

setting the seal system; and guiding and protecting the line in the opening during the setting.

18. The method as claimed in claim 17 further comprising disposing a cover over the line in the opening.

19. A wellbore system comprising:

a borehole in a subsurface formation;

a string disposed in the borehole;

a seal system disposed in the string, the system including:

a backup ring comprising an expandable body having a radially outer surface and a radially inner surface;

an opening in the body extending from the radially outer surface toward the radially inner surface, without reaching the radially inner surface, the opening being receptive to a line to guide and protect the line.

20. The wellbore system as claimed in claim 19 further comprising a line extending along the string, the line extending across the seal system along the outside surface of the backup ring by passing along the opening.

* * * * *